US009011262B2

(12) United States Patent
Peng

(10) Patent No.: US 9,011,262 B2
(45) Date of Patent: Apr. 21, 2015

(54) BILLIARD TABLE BALL PICK-UP BOX

(71) Applicant: Zhiwen Peng, Dongguan (CN)

(72) Inventor: Zhiwen Peng, Dongguan (CN)

( * ) Notice: Subject to any disclaimer, the term of this patent is extended or adjusted under 35 U.S.C. 154(b) by 142 days.

(21) Appl. No.: 13/929,774

(22) Filed: Jun. 27, 2013

(65) Prior Publication Data

US 2014/0221113 A1 Aug. 7, 2014

(30) Foreign Application Priority Data

Feb. 6, 2013 (CN) ..... 2013 2 0066671
Mar. 21, 2013 (CN) ..... 2013 2 0129927

(51) Int. Cl.
*A63B 15/00* (2006.01)
*A63D 15/00* (2006.01)

(52) U.S. Cl.
CPC ..... *A63D 15/003* (2013.01)

(58) Field of Classification Search
CPC ..... A63D 15/00; A63D 15/10; A63D 15/003; A63D 15/20; A63D 15/005
USPC ..... 473/1, 19, 20, 28, 40, 41
See application file for complete search history.

(56) References Cited

U.S. PATENT DOCUMENTS

| | | | | | |
|---|---|---|---|---|---|
| 742,467 | A * | 10/1903 | Marshall | 473/40 |
| 1,157,053 | A * | 10/1915 | Smith | 473/41 |
| 1,209,963 | A * | 12/1916 | Heffley | 473/28 |
| 1,286,075 | A * | 11/1918 | Olsen | 473/40 |
| 1,792,166 | A * | 2/1931 | Horstmann | 116/224 |
| 3,319,958 | A * | 5/1967 | Bender | 473/15 |
| 3,727,914 | A * | 4/1973 | Miller | 473/26 |
| 3,881,727 | A * | 5/1975 | Olson | 473/4 |
| 5,026,053 | A * | 6/1991 | Paterson et al. | 473/4 |
| 5,807,182 | A * | 9/1998 | Frost | 473/29 |
| 5,941,778 | A * | 8/1999 | Vasalech | 473/1 |
| 6,644,662 | B1 * | 11/2003 | Cao et al. | 273/123 R |
| 7,625,293 | B2 * | 12/2009 | Jago | 473/29 |
| 7,749,090 | B2 * | 7/2010 | Caron et al. | 473/33 |
| 7,753,802 | B2 * | 7/2010 | McCormick | 473/31 |
| 2010/0056287 | A1 * | 3/2010 | Chung | 473/10 |
| 2014/0024468 | A1 * | 1/2014 | Davis et al. | 473/20 |

* cited by examiner

*Primary Examiner* — Mitra Aryanpour

(57) ABSTRACT

Disclosed is a billiard table ball pick-up box, comprising a bottom bracket and a side cover located above the bottom bracket, wherein the side cover comprises a cover plate, a left side plate and a right side plate located on both sides of the cover plate, and a scoreboard located on the top of the cover plate. The left side plate, the right side plate and the scoreboard are all hinged with the cover plate, or one side of the left side plate and the right side plate is spliced with both sides of the cover plate respectively. The side cover of the present utility model can be unfolded to be flat or disassembled during transport, so that the same container can accommodate more side covers, thus reducing the transportation cost.

13 Claims, 6 Drawing Sheets

BILLIARD TABLE BALL PICK-UP BOX

BACKGROUND OF THE INVENTION

The present utility model relates to a ball pick-up box, and more especially, to a billiard table ball pick-up box capable of reducing the transportation cost.

Many billiard tables are provided with a ball pick-up box, such as foosball tables, air hockey tables, or multifunctional game tables. The space of containers will be wasted due to a large gap between the integrated side covers of the existing billiard table ball pick-up box when multiple side covers are stacked together during transport. However, unnecessary transportation costs will be increased indirectly as the freight is collected based on the container volume.

BRIEF SUMMARY OF THE INVENTION

The present utility model provides a billiard table ball pick-up box, which can reduce the space occupied by transportation, thus reducing the transportation cost.

To address the aforesaid technical problem, the present utility model adopts the following technical solution:

A billiard table ball pick-up box comprising a bottom bracket and a side cover located above the bottom bracket, wherein the side cover comprises a cover plate, a left side plate and a right side plate located on both sides of the cover plate, and a scoreboard located on the top of the cover plate. The left side plate, the right side plate, and the scoreboard are all hinged with the cover plate, wherein a cover body is formed integrally when the left side plate, the right side plate and the scoreboard are curved together with the cover plate respectively along the hinge point in the same direction.

A mounting plate is arranged on the left side plate and the right side plate, wherein mounting holes are arranged on the mounting plate.

The left side plate and the right side plate are provided with a lug for positioning.

The edge connecting the left side plate, the right side plate, and the cover plate is curved, wherein the cover plate is bent into an arc elastically along the curved edge.

In this solution, the left side plate, the right side plate, and the scoreboard are all hinged with the cover plate, wherein they can be unfolded to be flat during transport packaging. Therefore, the gap can be reduced, space saved, and the transportation cost reduced during the laminated packaging.

To address the aforesaid technical problem, the present utility model also adopts the following technical solution:

A billiard table ball pick-up box comprising a bottom bracket and a side cover located above the bottom bracket, wherein the side cover comprises a cover plate, a left side plate and a right side plate located on both sides of the cover plate, and a scoreboard located on the top of the cover plate. One side of the left side plate and the right side plate is spliced with both sides of the cover plate respectively, wherein the included angle between the left side plate, the right side plate and the cover plate is 80-120° respectively, and the scoreboard is hinged with the cover plate.

One or more connection holes are arranged on the edge of both sides of the cover plate and a convex structure engaging with the connection holes is arranged on the edge connecting the left side plate, the right side plate and the cover plate, wherein the left side plate and the right side plate are fixed on the cover plate by inserting the connection holes via the convex structure. Alternatively, one or more cylindrical mounting holes are arranged on both sides of the cover plate in the side direction and a connection column engaging with the cylindrical mounting holes is arranged on the edge connecting the left side plate, the right side plate and the cover plate, wherein the left side plate and the right side plate are fixed on the cover plate by inserting the cylindrical mounting holes via the connection column.

The edge connecting the left side plate, the right side plate and the cover plate is curved, wherein the cover plate is bent into an arc elastically along the curved edge.

A mounting plate is arranged on the left side plate and the right side plate, wherein mounting holes are arranged on the mounting plate.

The left side plate and the right side plate are provided with a lug for positioning.

In this solution, the side cover can be disassembled during transport packaging. Therefore, the gap can be reduced, the space saved and the transportation cost reduced during the laminated packaging.

Figure 1:
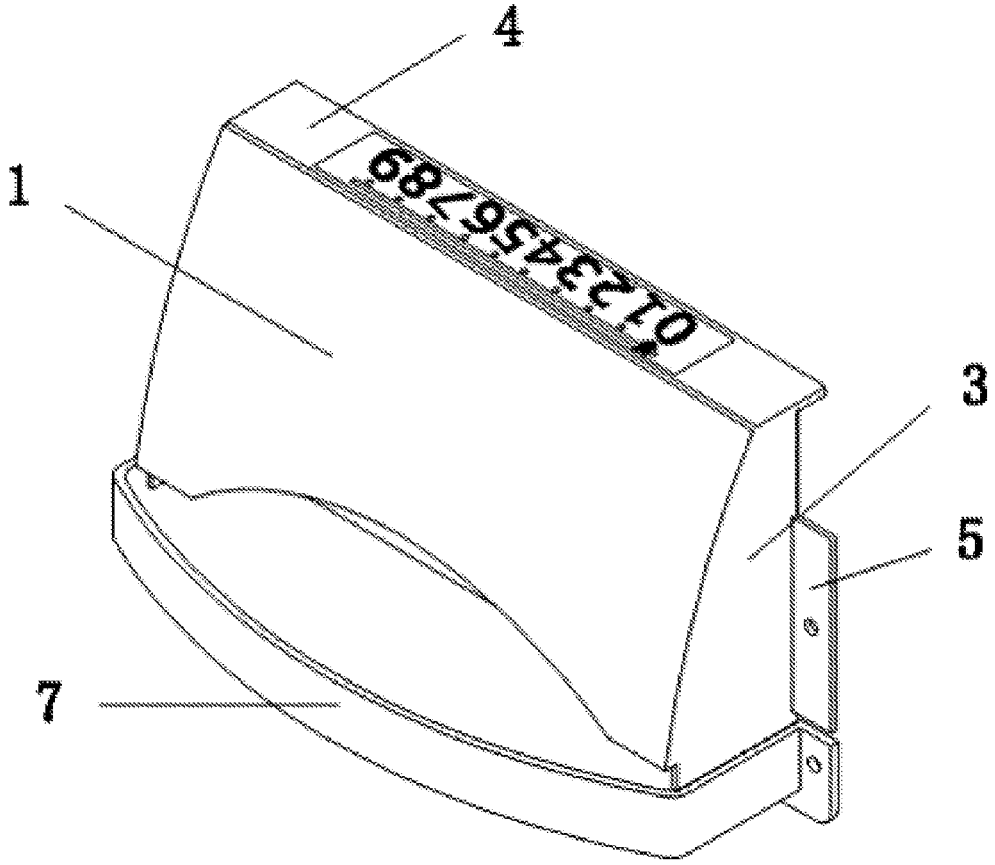
FIG. 1 shows the schematic view of the three-dimensional structure of Embodiment 1 according to the present utility model.
Figure 2:
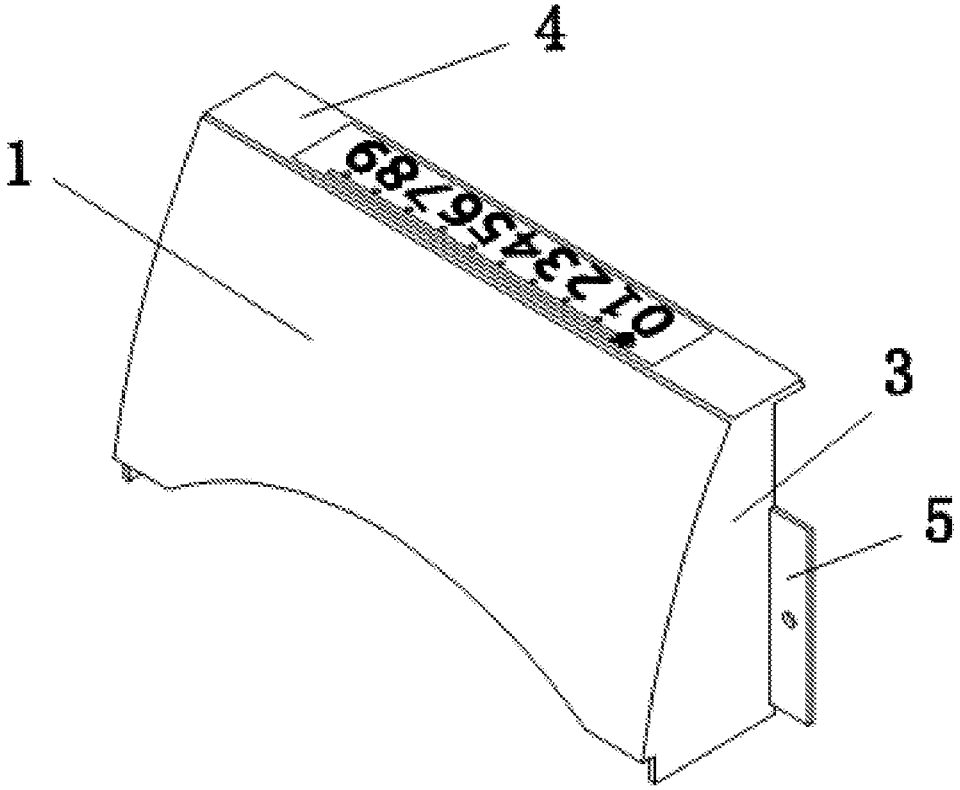
FIG. 2 shows the schematic view of the three-dimensional structure of the side cover of Embodiment 1 according to the present utility model.
Figure 3:
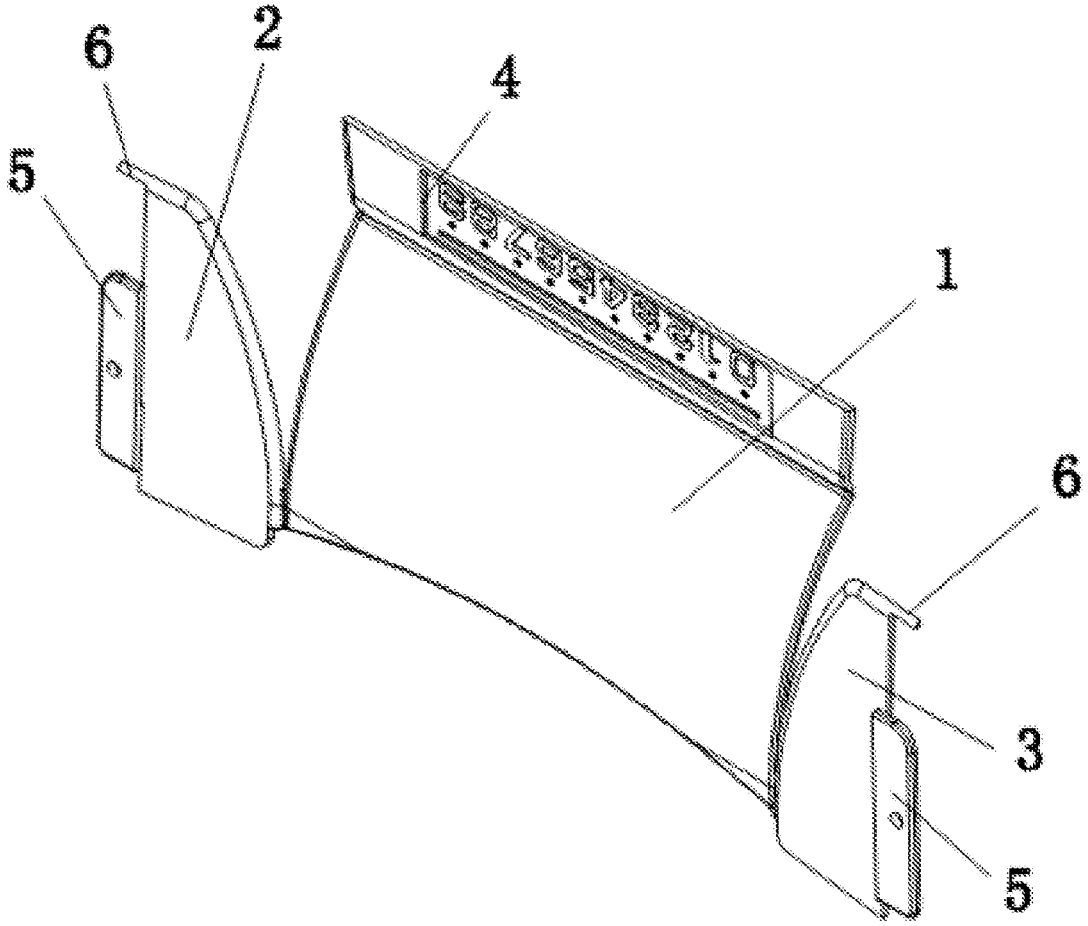
FIG. 3 shows the schematic view of the three-dimensional structure of the unfolded side cover of Embodiment 1 according to the present utility model.
Figure 4:
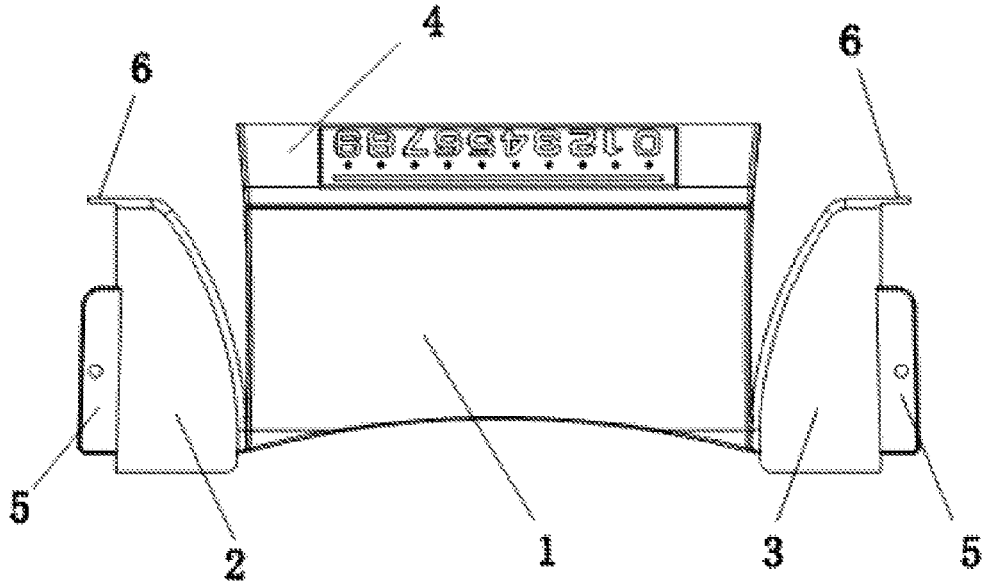
FIG. 4 shows the schematic view of the front structure of the unfolded side cover of Embodiment 1 according to the present utility model.

Numbers in the figure show: 1—cover plate, 2—left side plate, 3—right side plate, 4—scoreboard, 5—mounting plate, 51—mounting holes, 6—lug, 7—bottom bracket, 8—connection holes, 9—convex structure, 10—cylinderical mounting holes, 11—connection column.

DETAILED DESCRIPTION OF THE INVENTION

The present utility model is detailed in combination with the drawings below to facilitate the understanding for technicians skilled in this art.

Embodiment 1

As shown in FIG. 1~4, a billiard table ball pick-up box comprising a bottom bracket 7 and a side cover located above the bottom bracket 7, wherein the side cover comprises a cover plate 1, a left side plate 2 and a right side plate 3 located on both sides of the cover plate 1, and a scoreboard 4 located on the top of the cover plate 1. The left side plate 2, the right side plate 3 and the scoreboard 4 are all hinged with the cover plate 1, wherein a cover body is formed integrally when the left side plate 2, the right side plate 3 and the scoreboard 4 are curved together with the cover plate 1 respectively along the hinge point in the same direction. A mounting plate 5 is arranged on the left side plate 2 and the right side plate 3, wherein mounting holes are arranged on the mounting plate 5 that can be fixed on the edge of the billiard table with screws. The left side plate 2 and the right side plate 3 are provided with a lug 6 for positioning, and positioning holes engaging with the lug 6 are arranged on the edge of the billiard table. The edge connecting the left side plate 2, the right side plate 3 and the cover plate 1 is curved, wherein the cover plate 1 is bent into an arc elastically along the curved edge and recovered to a surface plate elastically during the unfolding of the side cover.

During the collective transportation and shipment, the entire side cover can be removed from the billiard table, the left side plate 2, the right side plate 3 and the scoreboard 4 can be unfolded to be flat along the hinge point of the cover plate 1, and multiple side covers can be stacked together for packing & binding. Therefore, the gap between the side covers can be compressed to a minimum, the occupied space saved significantly and the transportation cost thus reduced.

Embodiment 2

Figure 5:
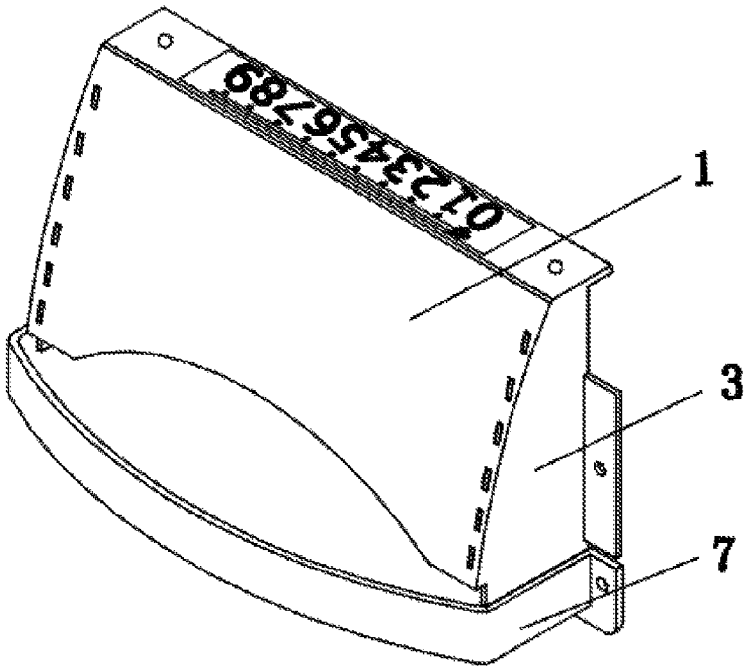
FIG. 5 shows the schematic view of the three-dimensional structure of Embodiment 2 according to the present utility model.
Figure 6:
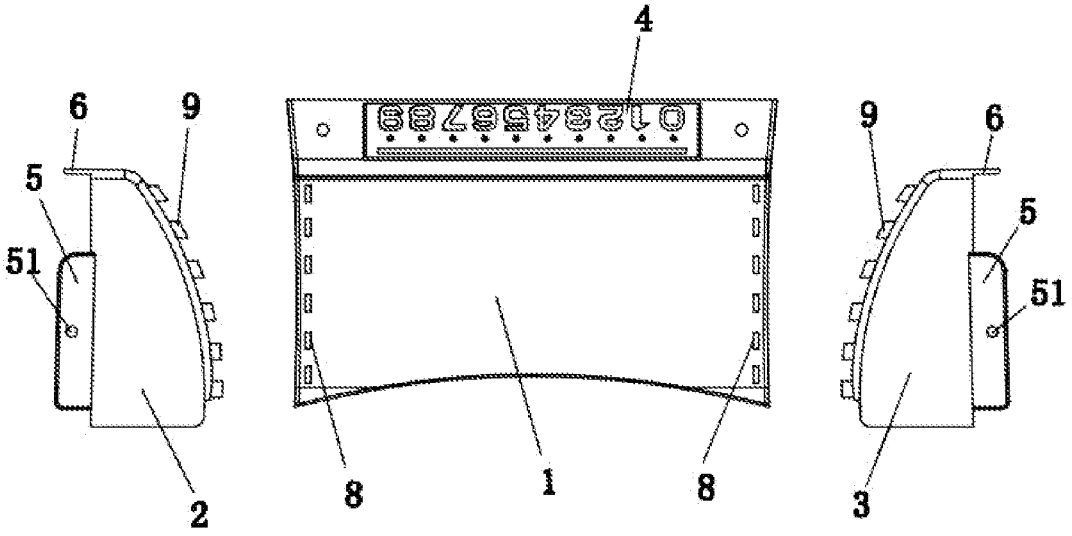
FIG. 6 shows the schematic view of the breakdown structure of the side cover parts of Embodiment 2 according to the present utility model.

As shown in FIGS. 5 and 6, a billiard table ball pick-up box comprising a bottom bracket 7 and a side cover located above the bottom bracket 7, wherein the side cover comprises a cover plate 1, a left side plate 2 and a right side plate 3 located on both sides of the cover plate 1, and a scoreboard 4 located on the top of the cover plate 1. One side of the left side plate 2 and the right side plate 3 is spliced with both sides of the cover plate 1 respectively, wherein the included angle between the left side plate 2, the right side plate 2 and the cover plate 1 is 80-120° respectively, and the scoreboard 4 is hinged with the cover plate 1. One or more connection holes 8 are arranged on the edge of both sides of the cover plate 1 and a convex structure 9 engaging with the connection holes 8 is arranged on the edge connecting the left side plate 2, the right side plate 3 and the cover plate 1, wherein the left side plate 2 and the right side plate 3 are fixed on the cover plate 1 by inserting the connection holes 8 via the convex structure 9. The edge connecting the left side plate 2, the right side plate 3 and the cover plate 1 is curved, wherein the cover plate 1 is bent into an arc elastically along the curved edge. A mounting plate 5 is arranged on the left side plate 2 and the right side plate 3, wherein mounting holes 51 are arranged on the mounting plate 5 and the side cover can be fixed on the billiard table through the mounting holes 51 via screws. The left side plate 2 and the right side plate 3 are provided with a lug 6 for positioning, and positioning holes engaging with the lug 6 are arranged on the billiard table.

During the collective transportation and shipment, the entire side cover can be removed from the billiard table, the left side plate 2 and the right side plate 3 can be disassembled from the cover plate 1, the cover plate 1 can be unfolded flat with the scoreboard 4 through the hinge point, and then each part can be stacked together respectively for packing & binding. Therefore, the packing gap can be compressed to a minimum, the occupied space saved significantly and the transportation cost thus reduced.

Embodiment 3

Figure 7:
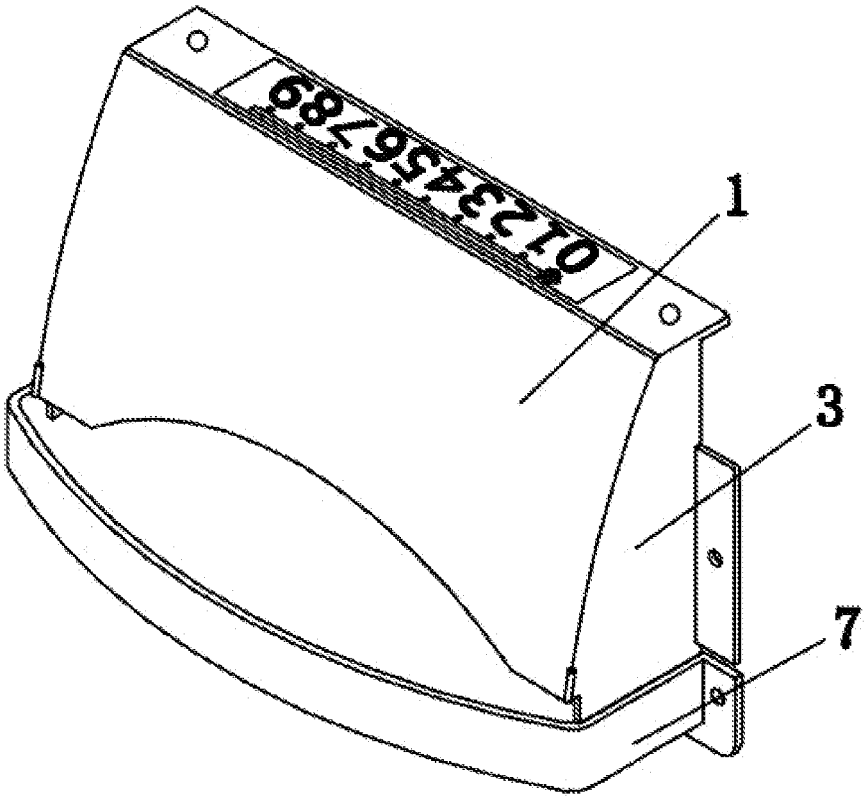
FIG. 7 shows the schematic view of the three-dimensional structure of Embodiment 3 according to the present utility model.
Figure 8:
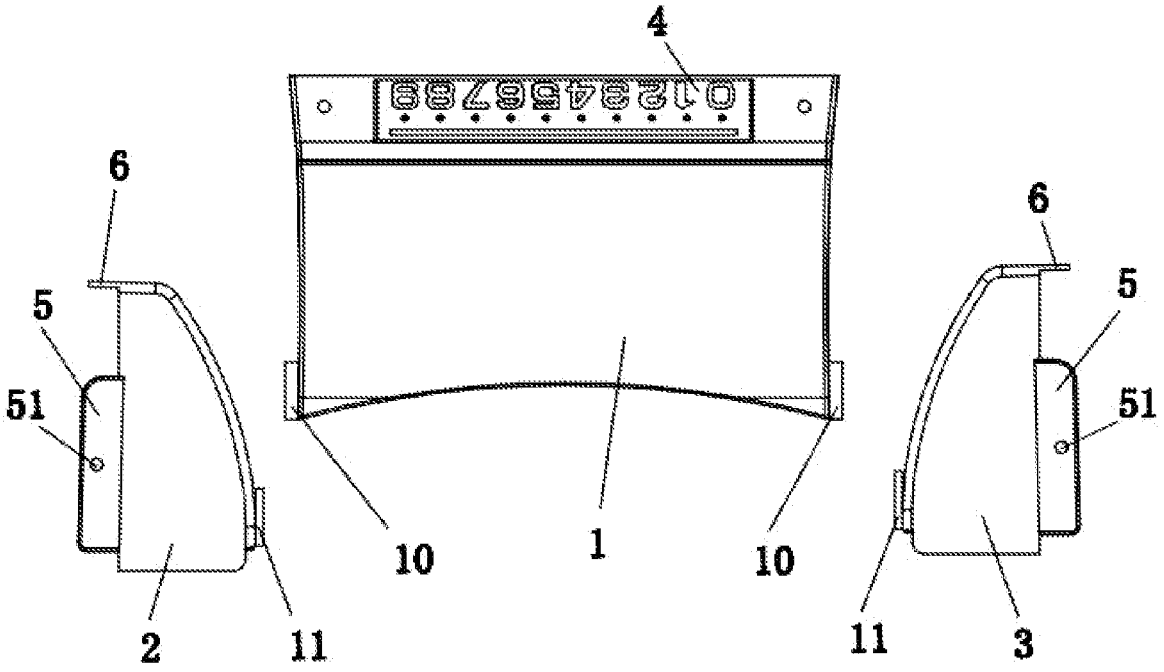
FIG. 8 shows the schematic view of the breakdown structure of the side cover parts of Embodiment 3 according to the present utility model.

As shown in FIGS. 7 and 8, a billiard table ball pick-up box comprises a bottom bracket 7 and a side cover located above the bottom bracket 7, wherein the side cover comprises a cover plate 1, a left side plate 2 and a right side plate 3 located on both sides of the cover plate 1, and a scoreboard 4 located on the top of the cover plate 1. One side of the left side plate 2 and the right side plate 3 is spliced with both sides of the cover plate 1 respectively, wherein the included angle between the left side plate 2, the right side plate 2 and the cover plate 1 is 80-120° respectively, and the scoreboard 4 is hinged with the cover plate 1. One or more cylindrical mounting holes 10 are arranged on both sides of the cover plate 1 in the side direction and a connection column 11 engaging with the cylindrical mounting holes 10 is arranged on the edge connecting the left side plate 2, the right side plate 3 and the cover plate 1, wherein the left side plate 2 and the right side plate 3 are fixed on the cover plate 1 by inserting the cylindrical mounting holes 10 via the connection column 11. The edge connecting the left side plate 2, the right side plate 3 and the cover plate 1 is curved, wherein the cover plate 1 is bent into an arc elastically along the curved edge. A mounting plate 5 is arranged on the left side plate 2 and the right side plate 3, wherein mounting holes 51 are arranged on the mounting plate 5 and the side cover can be fixed on the billiard table through the mounting holes 51 via screws. The left side plate 2 and the right side plate 3 are provided with a lug 6 for positioning, and positioning holes engaging with the lug 6 are arranged on the billiard table.

During the collective transportation and shipment, the entire side cover can be removed from the billiard table, the left side plate 2 and the right side plate 3 can be disassembled from the cover plate 1, the cover plate 1 can be unfolded flat with the scoreboard 4 through the hinge point, and then each part can be stacked together respectively for packing & binding. Therefore, the packing gap can be compressed to a minimum, the occupied space saved significantly and the transportation cost thus reduced.

The embodiments above are preferred solutions to realize the present utility model. Any direct substitution or equivalent replacement of the present utility model without departing from the concept of the present utility model shall be covered within the scope of the present utility model to be protected.

What is claimed is:

1. A billiard table ball pick-up box, comprising a bottom bracket (7) and a side cover located above the bottom bracket (7), wherein the side cover comprises a cover plate (1), a left side plate (2) and a right side plate (3) located on both sides of the cover plate, and a scoreboard (4) located on the top of the cover plate, characterized in that the left side plate (2), the right side plate (3) and the scoreboard (4) are all hinged with the cover plate (1), wherein a cover body is formed integrally when the left side plate, the right side plate and the scoreboard are curved together with the cover plate respectively along the hinge point in the same direction.

2. The billiard table ball pick-up box according to claim 1, characterized in that a mounting plate (5) is arranged on the left side plate (2) and the right side plate (3), wherein mounting holes are arranged on the mounting plate.

3. The billiard table ball pick-up box according to claim 2, characterized in that the left side plate (2) and the right side plate (3) are provided with a lug (6) for positioning.

4. The billiard table ball pick-up box according to claim 3, characterized in that the edge connecting the left side plate (2), the right side plate (3) and the cover plate (1) is curved, wherein the cover plate is bent into an arc elastically along the curved edge.

5. A billiard table ball pick-up box, comprising a bottom bracket (7) and a side cover located above the bottom bracket (7), wherein the side cover comprises a cover plate (1), a left side plate (2) and a right side plate (3) located on both sides of the cover plate, and a scoreboard (4) located on the top of the cover plate, characterized in that one side of the left side plate (2) and the right side plate (3) is spliced with both sides of the cover plate (1) respectively, wherein the included angle between the left side plate, the right side plate and the cover plate is 80-120° respectively, and the scoreboard is hinged with the cover plate.

6. The billiard table ball pick-up box according to claim 5, characterized in that one or more connection holes (8) are arranged on the edge of both sides of the cover plate (1) and a convex structure (9) engaging with the connection holes is arranged on the edge connecting the left side plate (2), the right side plate (3) and the cover plate, wherein the left side plate and the right side plate are fixed on the cover plate by inserting the connection holes via the convex structure.

7. The billiard table ball pick-up box according to claim 6, characterized in that the edge connecting the left side plate (2), the right side plate (3) and the cover plate (1) is curved, wherein the cover plate is bent into an arc elastically along the curved edge.

8. The billiard table ball pick-up box according to claim 7, characterized in that a mounting plate (5) is arranged on the left side plate (2) and the right side plate (3), wherein mounting holes are arranged on the mounting plate.

9. The billiard table ball pick-up box according to claim 8, characterized in that the left side plate (2) and the right side plate (3) are provided with a lug (6) for positioning.

10. The billiard table ball pick-up box according to claim 5, characterized in that one or more cylindrical mounting holes (10) are arranged on both sides of the cover plate (1) in the side direction and a connection column (11) engaging with the cylindrical mounting holes is arranged on the edge connecting the left side plate (2), the right side plate (3) and the cover plate, wherein the left side plate and the right side plate are fixed on the cover plate by inserting the cylindrical mounting holes via the connection column.

11. The billiard table ball pick-up box according to claim 10, characterized in that the edge connecting the left side plate (2), the right side plate (3) and the cover plate (1) is curved, wherein the cover plate is bent into an arc elastically along the curved edge.

12. The billiard table ball pick-up box according to claim 11, characterized in that a mounting plate (5) is arranged on the left side plate (2) and the right side plate (3), wherein mounting holes (51) are arranged on the mounting plate.

13. The billiard table ball pick-up box according to claim 12, characterized in that the left side plate (2) and the right side plate (3) are provided with a lug (6) for positioning.

* * * * *